US005625985A

United States Patent [19]

Johnson

[11] Patent Number: 5,625,985

[45] Date of Patent: May 6, 1997

[54] DOCK PLANK ASSEMBLY

[76] Inventor: Richard D. Johnson, 19400 Orwell Ave., Marine-On-St. Croix, Minn. 55047

[21] Appl. No.: 434,014

[22] Filed: May 3, 1995

Related U.S. Application Data

[63] Continuation-in-part of Ser. No. 5,707, Jan. 19, 1993, Pat. No. 5,412,915.

[51] Int. Cl.[6] ..... E01D 19/02; E04B 5/02

[52] U.S. Cl. ..... 52/177; 52/483.1; 52/506.06; 52/585.1; 14/75; 405/218

[58] Field of Search ..... 52/177, 483.1, 52/506.01, 582.1, 585.1, 263, 180, 181, 480, 223.7, 506.06; 14/73, 75, 76; 405/218, 219, 220, 221

[56] References Cited

U.S. PATENT DOCUMENTS 4,349,297 9/1982 Misener ..... 405/221
4,566,243 1/1986 Dahlin ..... 52/177
4,709,435 12/1987 Stemler et al. ..... 14/73
4,845,907 7/1989 Meek ..... 52/177

*Primary Examiner*—Michael Safavi
*Attorney, Agent, or Firm*—Jacobson & Johnson

[57] ABSTRACT

A dock plank assembly formed from at least two elongated polymer plastic plank having a first support end, a second support end, a top surface for walking on, and an integral longitudinal web therein for providing rigidity and support to the planks with the webs having an opening therein for receiving a free-span rib with the free-span rib spaced from the support ends of the planks and extending transversely through the opening in the webs of the plank to provide rigidity and additional individual support for each of said planks and for providing coactive support for the planks as a unit to thereby maintain adjacent planks in surface walking condition with respect to one another to prevent a user from tripping over protruding edges on the planks.

11 Claims, 13 Drawing Sheets

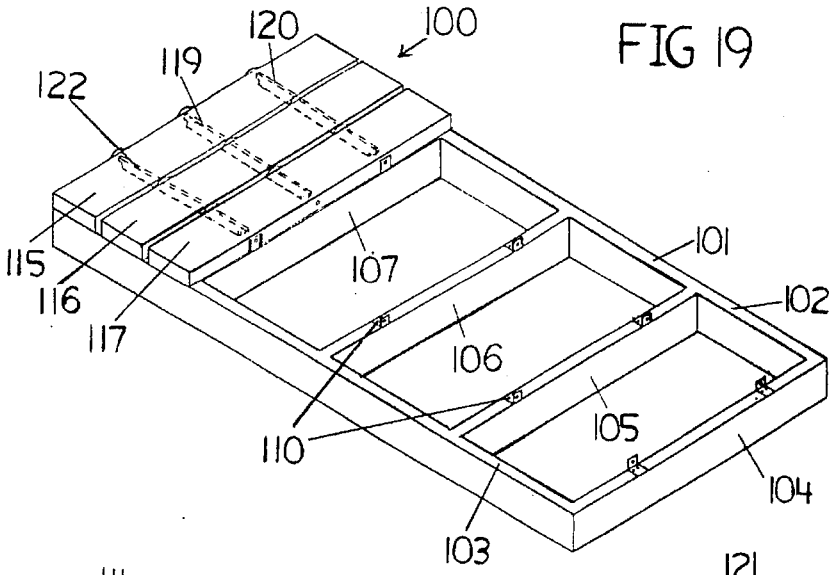
FIG 19
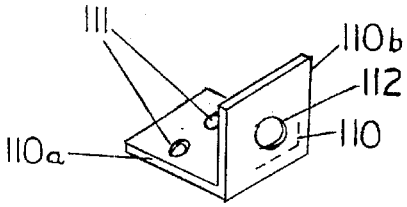
FIG 19a
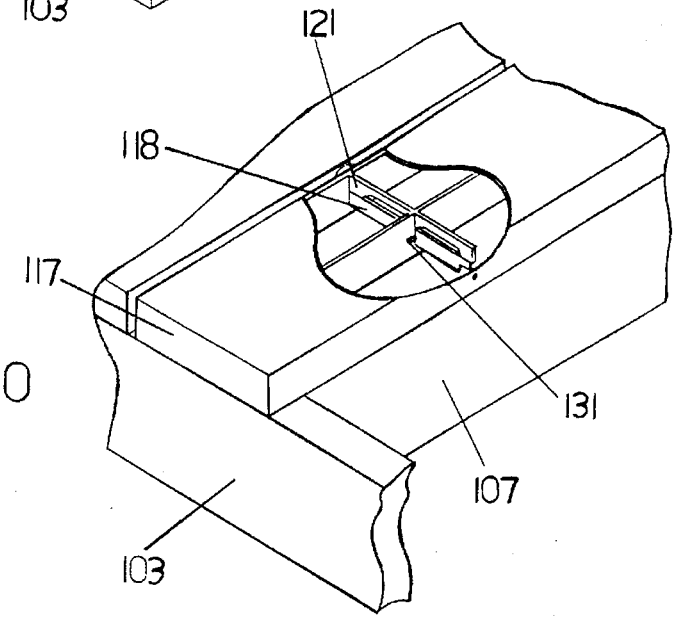
FIG 20
FIG 21
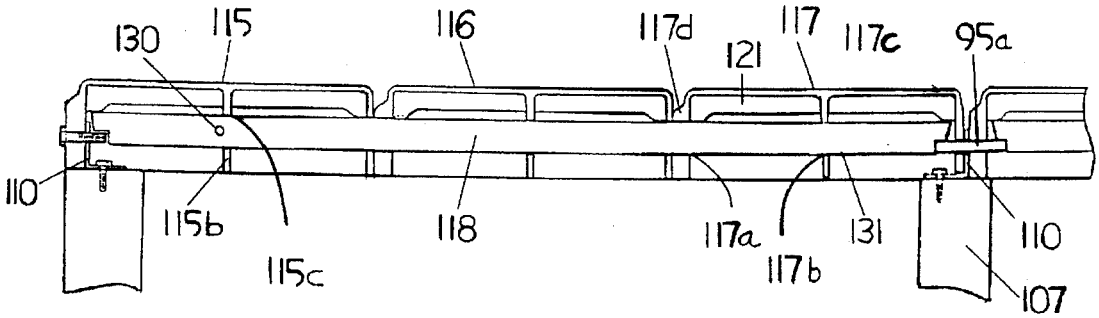

DOCK PLANK ASSEMBLY

This application is a continuation-in-part of my patent application Ser. No. 08/005,707 filed Jan. 19, 1993, titled Dock Plank Assembly, now U.S. Pat. No. 5,412,915.

FIELD OF THE INVENTION

This invention relates generally to dock planks and more specifically, to improvements to dock plank assemblies to maintain the integrity of the dock plank assembly.

BACKGROUND OF THE INVENTION

The concept of planks for use in docks is well known in the art. Typically, wooden planks are used for docks because of their low cost and light weight. However, wooden planks have certain disadvantages.

One of the major disadvantages of wooden planks is that the dock is continually exposed to the weather and eventually, the planks rot and must be replaced. Oftentimes, the stringers and support members are sound and do not have to be replaced; however, frequently it is needed to replace the dock planks.

One of the difficulties of making polymer plastic planks, particularly polymer plastic dock planks, is that, in order to make the planks sufficiently strong, they become either too massive and too expensive for use as a dock plank or they become difficult to fabricate.

The present invention provides both a process and method for making a dock plank which has a general rectangular, open-box shape and which is reinforced with a separate reinforcing rib located integral with and transverse to a group of dock planks. The reinforced dock plank can be attached directly to the support members of the dock and secured thereto by fasteners located on the reinforcing rib thereby providing both reinforcement to the plastic dock plank and, simultaneously, providing means for further securing a plank to the dock and for securing the plank to an adjacent dock plank.

DESCRIPTION OF THE PRIOR ART

U.S. Pat. No. 4,907,387 shows a U-shaped dock plank having a wood core and an extruded plastic channel extending over the wood core.

U.S. Pat. No. 4,798,029 shows a hold-down clamp for holding adjacent I-beams of a grate proximate one another and in engagement with a support member.

U.S. Pat. No. 4,566,243 shows a plank-grating assembly which can be assembled to other planks without the use of separate fasteners.

U.S. Pat. No. 4,266,381 shows an extruded threadway with a panel having interlock panels for securing to a cross-beam.

U.S. Pat. No. 3,999,397 shows a modular dock system, comprised of external aluminum panels.

U.S. Pat. No. 1,900,319 shows a floating dock with dove-tail sections for interlocking to one another.

U.S. Pat. No. 4,386,441 shows a folding dock having wheels mounted in the dock for moving the dock in its folded state.

U.S. Pat. No. 4,126,006 shows a boat-dock assembly with portable sections which are hingedly connected to each other through laterally extending members which laterally engage one another.

U.S. Pat. No. 3,555,762 shows a false floor with interlocking metal sections for locking one side of the floor to an adjacent side.

U.S. Pat. No. 3,143,939 shows a landing mat structure with interlocking members for locking one side of a member to another side of a similar member.

U.S. Pat. No. 3,200,549 shows a cargo-supporting structure with interlocking members.

U.S. Pat. No. 3,046,852 shows a grating having a U-shaped clip for securing adjacent edges of the grating in a side-to-side manner.

U.S. Pat. No. 5,054,253 shows a grating mat assembly with clips for securing adjacent members to one another to provide a grating map.

U.S. Pat. No. 4,845,907 shows a panel module having L-shaped members which lock together to hold one panel proximate to another panel.

U.S. Pat. No. 4,897,299 shows a grating of fiber-reinforced plastic wherein a bolt extends through the gratings to hold adjacent members together.

U.S. Pat. No. 4,349,297 shows a boat dock comprised of plastic resin planks.

U.S. Pat. No. 3,964,221 shows a platform section having interfitting members which can be locked together to form a dock.

U.S. Pat. No. 5,009,045 shows an extended channel-shaped plastic dock section plank having channels thereon for diverting the water away from the top of the plank.

BRIEF DESCRIPTION OF THE DRAWINGS

FIG. 19 shows a perspective of a dock assembly being partially supported on a frame by a plurality of ribs and FIG. 19A shows a support of FIG. 19;

FIG. 20 shows a partial cut-away view revealing the internal rib support of my dock plank assembly; and FIG. 21 shows a cross sectional view illustrating the rib engagement with each of the planks of the dock assembly of FIG. 19.

SUMMARY OF THE INVENTION

Figure 1:
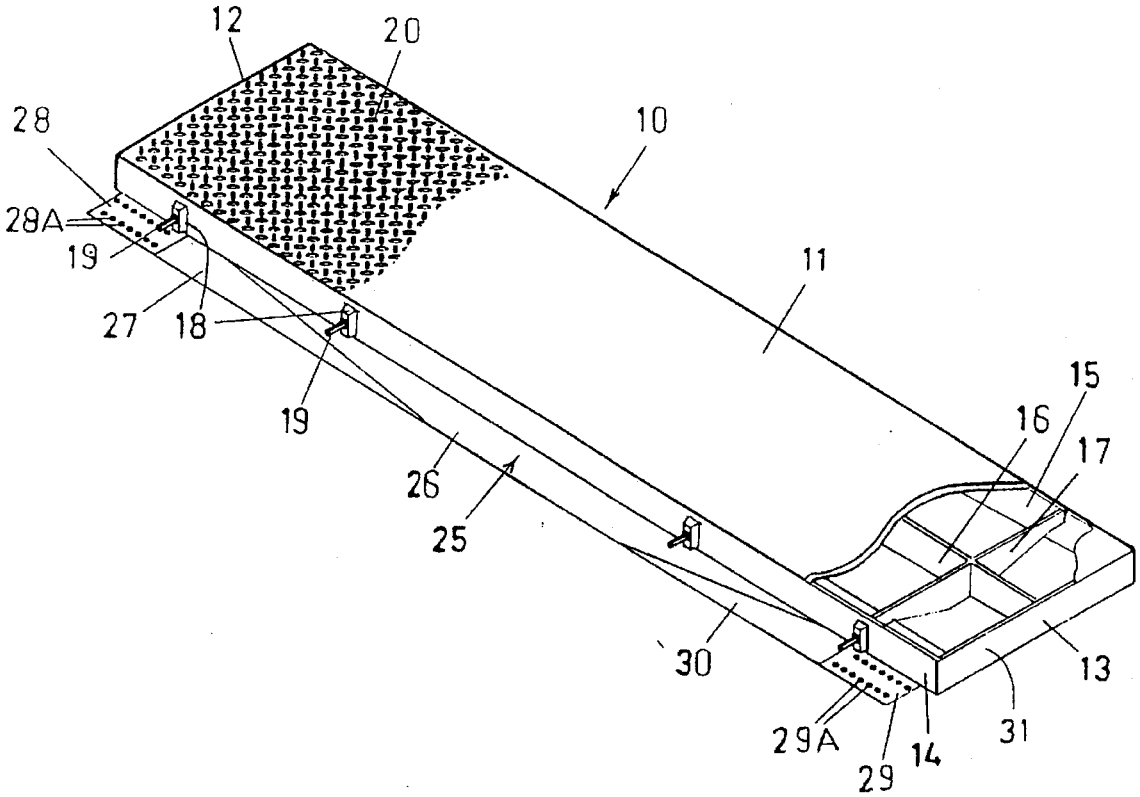
FIG. 1 is a perspective view of my dock plank.

Briefly, the invention comprises an injection-molded plank for forming a dock with the plank comprising an elongated member having a generally box-like shape with a top surface for walking on, a front side, and a backside having a plurality of openings therein. The front side has a plurality of spacers mounted on the front side to space one plank from an adjacent plank. A separate reinforcing free-span rib is secured transversely to a set of planks to provide stiffening and support to the individual planks and to provide coactive support to adjoining planks to maintain the dock planks in good surface walking order even though adjacent dock planks can be subject to temperature differences that may cause the dock planks to bend or deflect in response to temperature changes.

DESCRIPTION OF THE PREFERRED EMBODIMENT

FIGS. 1–4, reference numeral 10, generally identifies my injection-molded dock plank, having a general elongated and rectangular shape with a longitudinal reenforcement rib. FIGS. 19–21, reference numeral 100, generally identifies my dock plank assembly with transverse ribs for maintaining the integrity of my dock plank assembly.

Referring to FIGS. 1–4 plank 10 has a top surface 11 which together with sides 14 and 15 and ends 12 and 13 define the shape of a box without a cover. Extending lengthwise underneath surface 11 is an integral longitudinal rib 16 and extending cross-wise is an integral lateral rib 17. While only two integral ribs are shown, more or fewer integral ribs could be used.

Ribs 16 and 17 are integrally molded to the sides and undersurface of the dock plank to form a stiffened one-piece dock plank. In the embodiment shown, semicircular protrusions 20 are molded into top surface 11 and extend upward from the surface to provide gripping ridges for engaging a user's foot.

Located on side 14 of plank 10 is a set of spacers 18 and pins 19 which form a spaced lateral shiftable, mechanical connection between adjacent planks. Extending lengthwise along the inside of plank 10 and side 14 is a separate metal one-piece reinforcing rib 25. Reinforcing rib 25 comprises a multi-angled member to provide added stiffness for plank 10 as well as provide means for securing plank 10 to a dock support. Typically rib 25 may be made from corrosion resistant material such as galvanized metal or the like.

Figure 7:
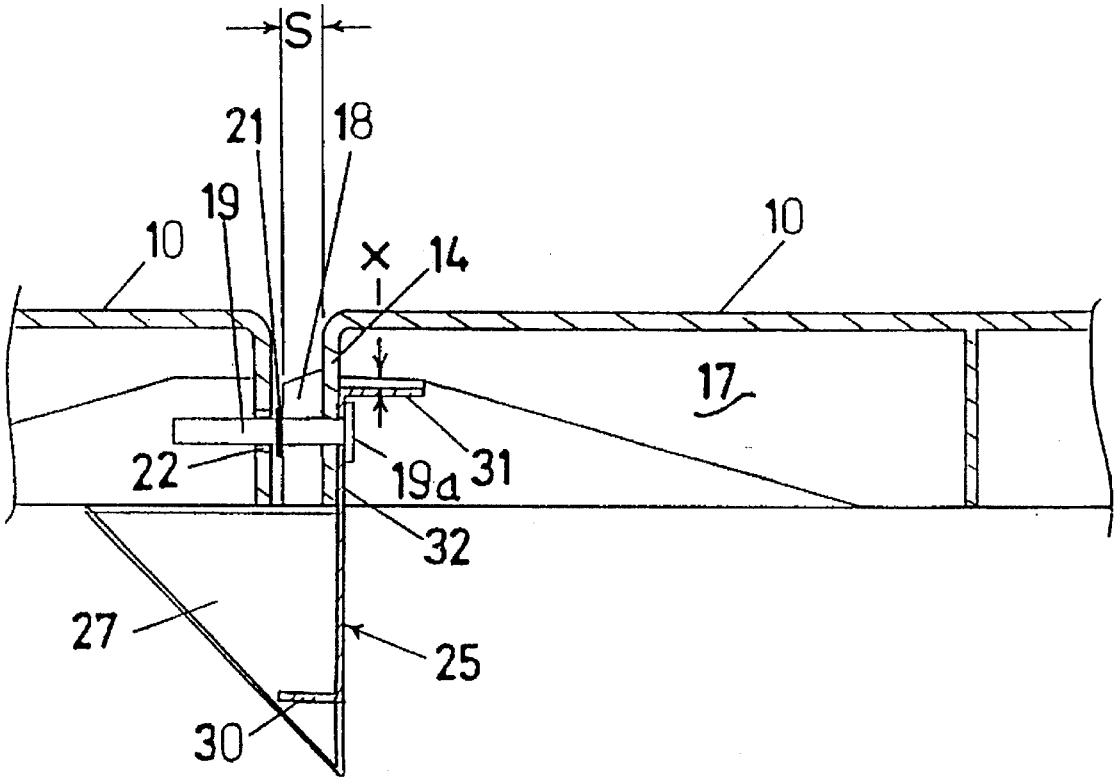
FIG. 7 is a partial cut-away taken along line 7—7 of FIG. 5.

FIGS. 1–4 and FIG. 7 show one-piece reinforcing rib 25 in greater detail. Rib 25 includes a first flat, elongated section 31 extending perpendicular to side 14 (FIG. 1) and a similar flat section 32 (FIG. 7) located at a right angle to section 31 which extends along side 14 of dock plank 10 (FIG. 7). Connected to one end of section 32 is a first triangular shaped wing member 30 (FIG. 7) which extends upward to a rectangular dock fastener plate 29 (FIG. 1) having a plurality of openings **29*a* therein for securing fastener plate 29 to a dock support. Similarly, connected to the opposite end of section 32 is a second triangular shaped wing member 27 (FIG. 1 and 7) which extends upward to fastener plate 28 (FIG. 1) which has a plurality of openings 28*a* therein for securing fastener plate 28** to a dock support.

Figure 2:
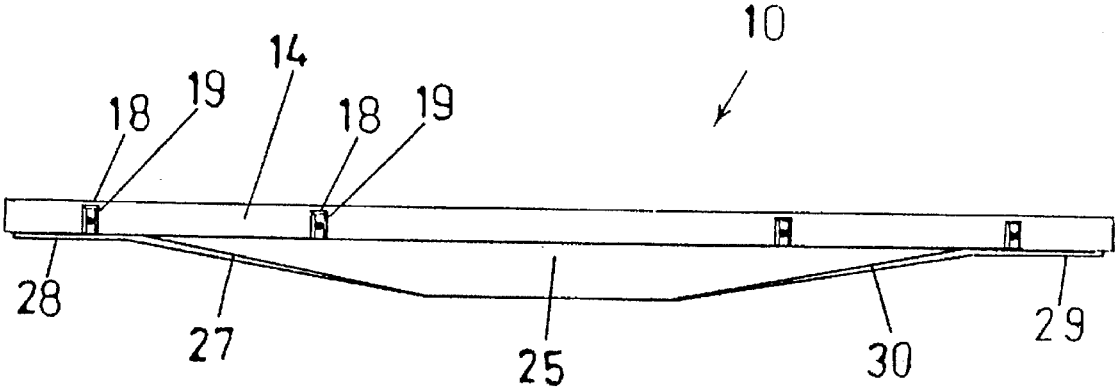
FIG. 2 is a front view of my dock plank of FIG. 1.
Figure 3:
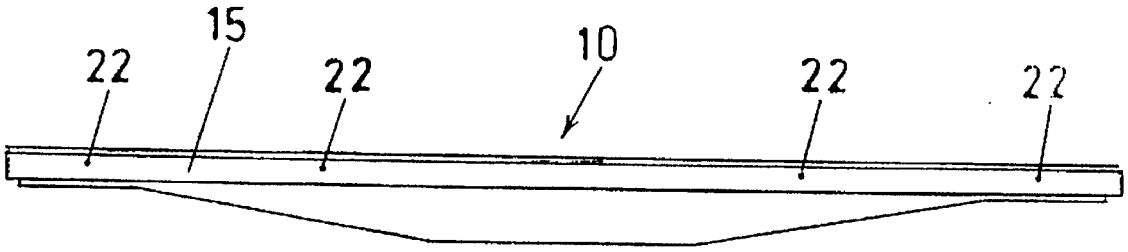
FIG. 3 is a rear view of the dock plank of FIG. 1.
Figure 4:
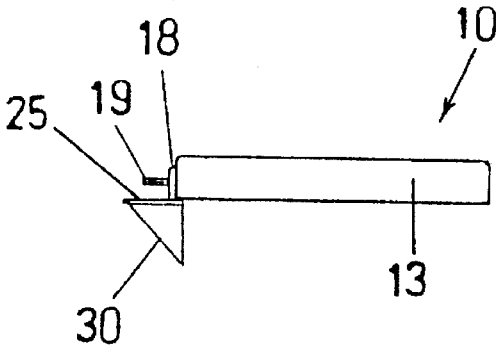
FIG. 4 is an end-view of the dock plank of FIG. 1.

The multi-angled reinforcing rib 25 provides stiffness and support to the dock plank and can best be illustrated by referring to multiple figures. FIG. 2 shows a front view of rib 25; FIG. 3 shows a rear view; FIG. 4 shows an end view; and FIG. 1 shows a perspective view of rib 25 while FIG. 7 shows a cross-sectional view of rib 25. By use of rib 25 as an under attachment allows the molded surfaces of the dock planks to provide the dock wear surface.

Figure 6:
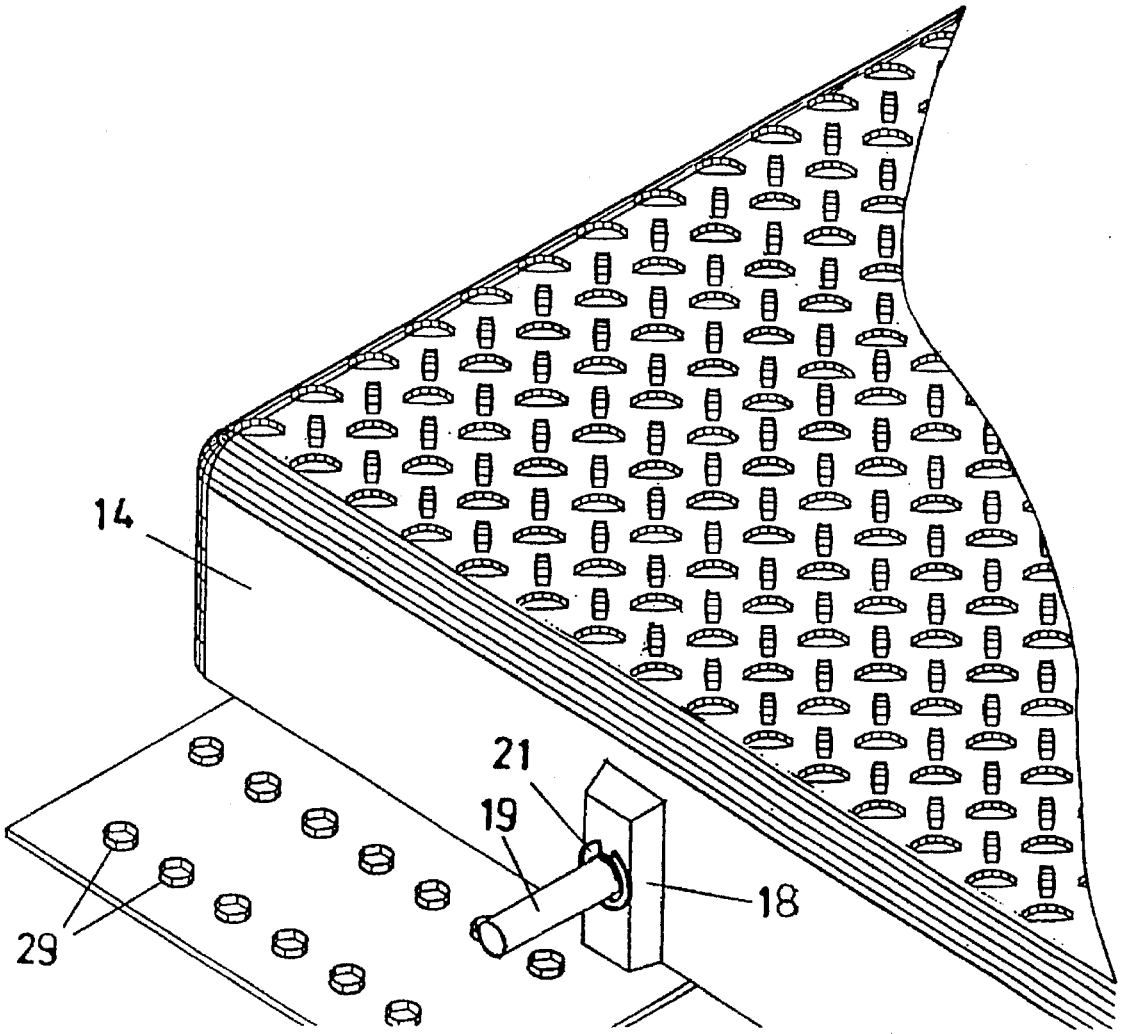
FIG. 6 is a partial enlarged view of the dock plank of FIG. 1 showing the spacer and pin connector.

The spacer and pin mechanism for securing dock plank 10 to an adjacent dock plank in a shiftable relationship is illustrated in FIGS. 1, 6 and 7. Since each of the spacer and pin mechanisms on plank 10 are identical, only one will be described. FIGS. 6 and 7 show spacer 18 extending outward a distance "s" typically ⅜- to ½-inch from side 14. The purpose of the spacer is to prevent the side of an adjacent dock plank from contacting side 14 of the plank to allow water to drain off between adjacent dock planks. Extending through spacer 18 and side 14 is a cylindrical pin 19 having a cylindrical head **19*a* in engagement with section 32 of rib 25 (FIG. 7). A retaining washer 21 (FIG. 6) secures pin 19 to spacer 18. Pin 19 serves two functions. First, it secures reinforcing rib 25 to plank 10, thus stiffening and providing greater rigidity to plank 10. Second, pin 19 extends sufficiently outward from side 14 so that the free end of pin 19 can engage a mating larger opening 22 (FIGS. 3 and 7) in the backside of an adjacent dock plank to thereby hold two planks 10** proximate one another in a shiftable relationship.

Figure 5:
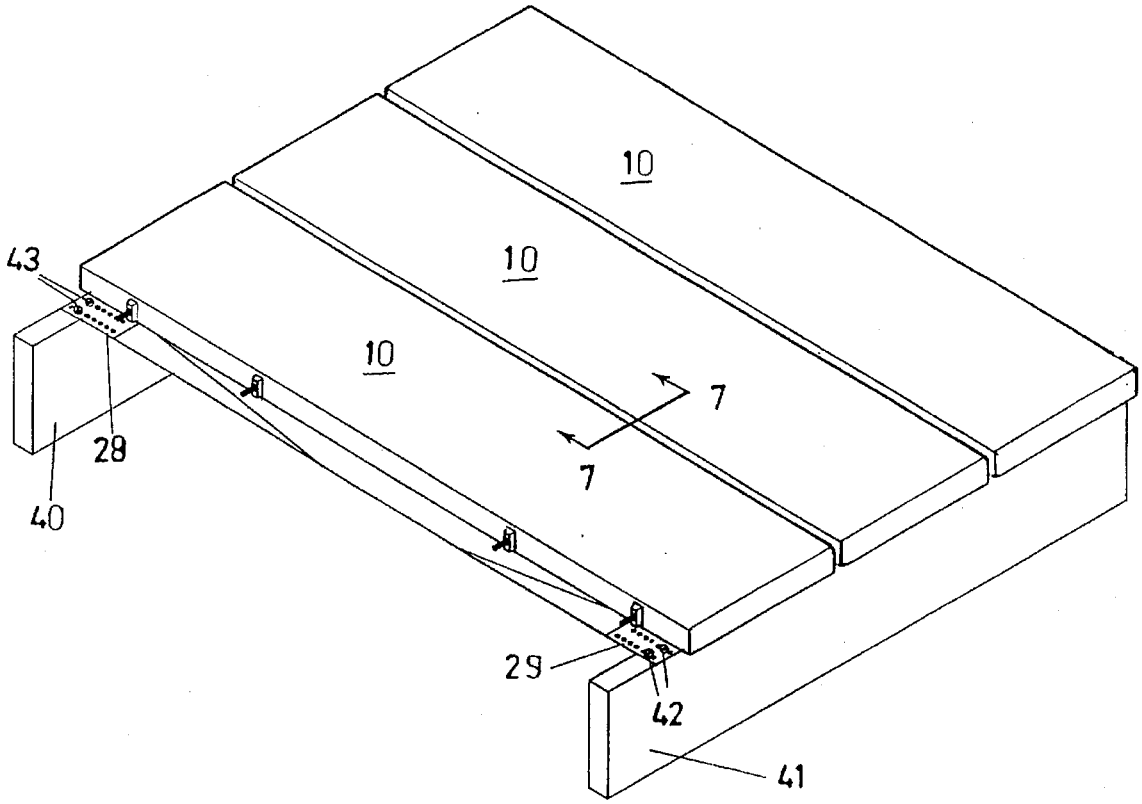
FIG. 5 is a perspective view of my dock planks located on dock supports.
Figure 8:
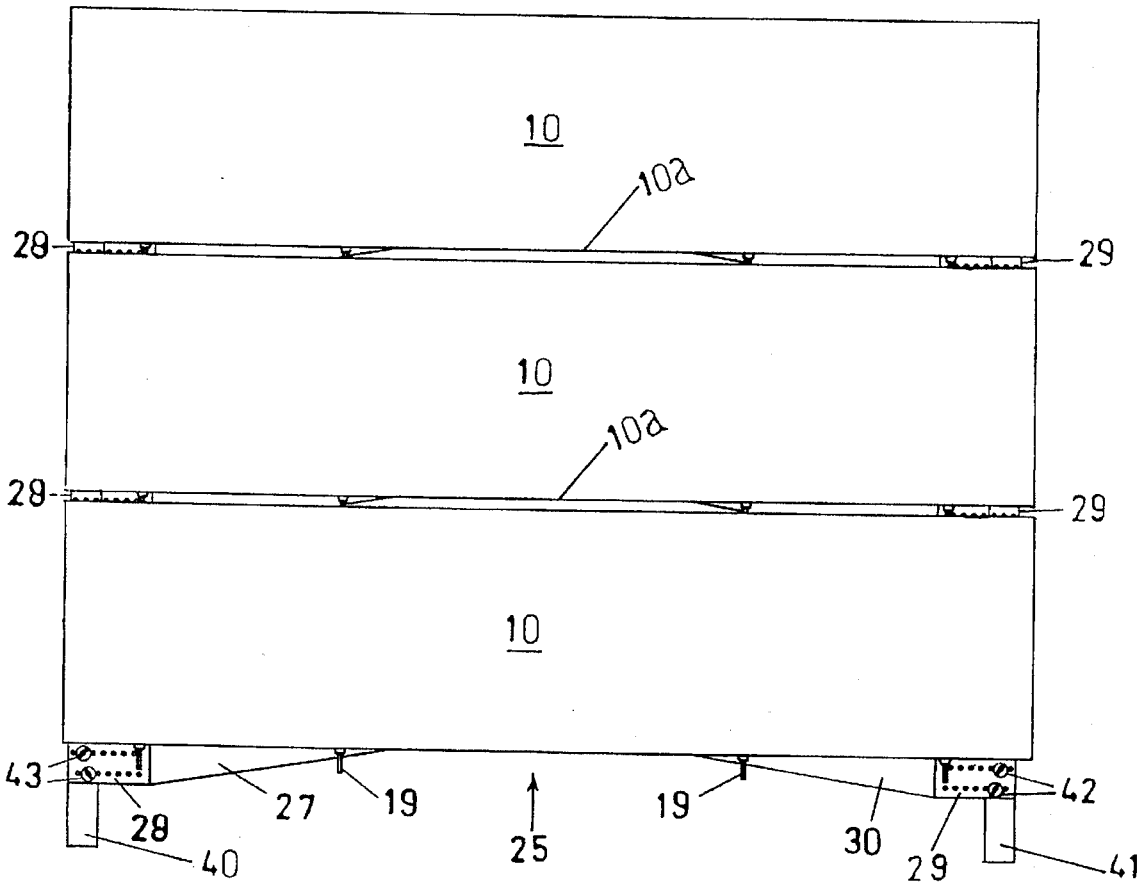
FIG. 8 is a top view of a portion of a dock.

To illustrate the assembly of dock planks 10 to produce a dock, refer to FIGS. 5 and 8 which show a portion of a dock containing three identical dock planks 10 which are secured to parallel spaced dock support stringers 40 and 41. A first pair of fasteners comprising screws 42 extends through holes **29*a* and rib fastener plate 29 to secure rib fastener plate 29 and dock plank 10 thereto. Similarly, a second pair of fasteners comprising screws 43 extends through holes 28*a* to secure rib fastener plate 28 to support member 40. Fastening reinforcing rib 25 to both supports 40 and 41 holds one side of plank 10 and consequently pins 19 in a fixed lateral extended position so that a plurality of dock planks can be laterally and shiftably secured to each other to prevent lateral movement of the dock planks with respect to each other. FIGS. 5 and 8 illustrate three dock planks with each of the reinforcing ribs 25 of each plank secured to support members 40 and 41 through identical fastener plates 28 and 29. Thus, the present invention allows one to build a dock one plank at a time by securing reinforcing rib 25 to the stringer and then inserting the mating openings in the backside of another plank onto the cylindrical pins in the second plank to thereby laterally secure the opposite edge of the plank. The top view shown in FIG. 8 reveals that gaps 10*a* extend between adjacent planks to direct water around each plank. In addition, the wing members 27 and 30** direct water away from the supports to the inside of the dock.

FIG. 7 shows in greater detail the lateral restraining but shiftable relation between adjacent planks 10. Opening 22 is larger than the diameter of pin 19 to permit ease in assembly as well as to allow a small amount of flexing or shifting between individual planks to thereby distribute stresses on the dock over a greater area. The larger the opening the more that the planks can shift with respect to one another. In most instances the diameter of opening 22 is about twice the diameter of the pin. If greater lateral shiftably is desired the mating opening can be made with an elongated opening having the longer dimension extending parallel to rib 25. In addition, rib section 31 is spaced from integral rib 17 (FIG. 7) a distance denoted by x (typically ⅛-inch) to permit flexing of plank 10 without having section 31 contact rib 17 and thus create a pressure point on rib 25.

Figure 9:
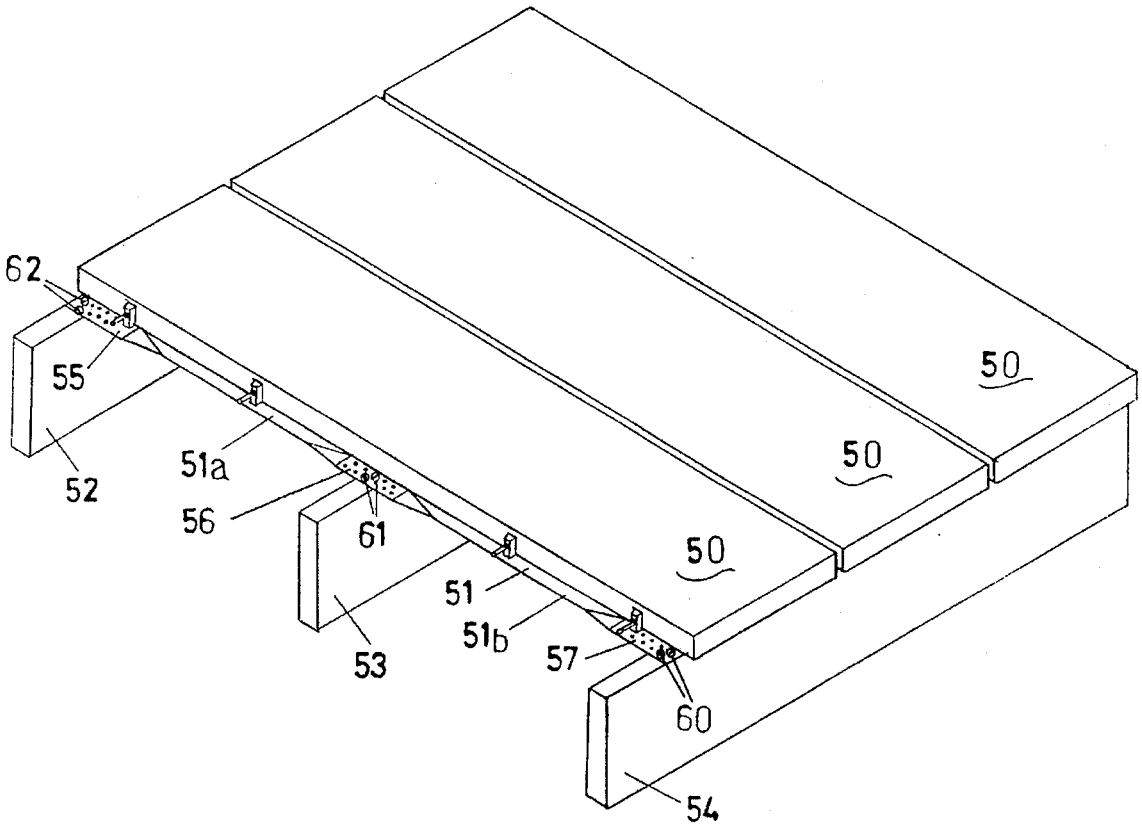
FIG. 9 is a perspective view of an alternate dock plank.
Figure 10:
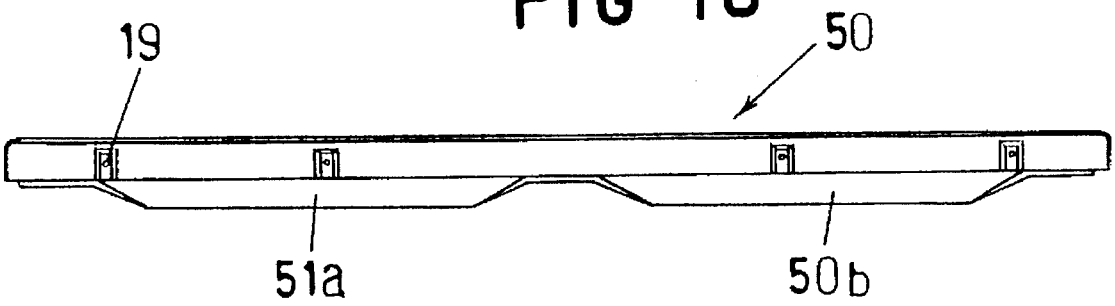
FIG. 10 is a front view of the dock plank of FIG. 9.
Figure 11:
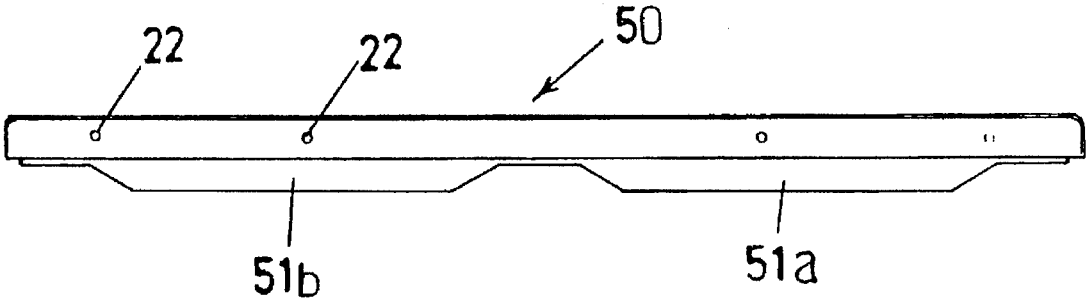
FIG. 11 is a rear-view of the dock plank of FIG. 9.
Figure 12:
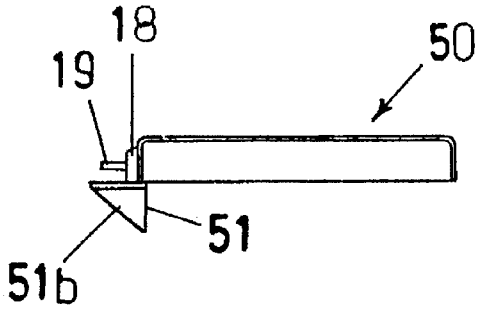
FIG. 12 is a side-view of the dock plank of FIG. 9.

While the invention is shown and described for use with two parallelly spaced dock stringers, my dock planks can also be used with multiple support members 52, 53 and 54 (FIG. 9). In this embodiment, three fastening plates 55, 56 and 57 are used to secure the dock plank 50 by use of fasteners such as screws 60, 61 and 62.

In the embodiment of FIGS. 9–12, two vertical portions of rib 51*b* extend downward; that is, section 51*a* extends downward between supports 52 and 53 to provide stiffening for the portion of plank 50 located between support members 52 and 53 and similarly, section 51*b* extends downward between support members 53 and 54 to provide further stiffening for the portion of plank 50 located between support members 53 and 54.

Figure 13:
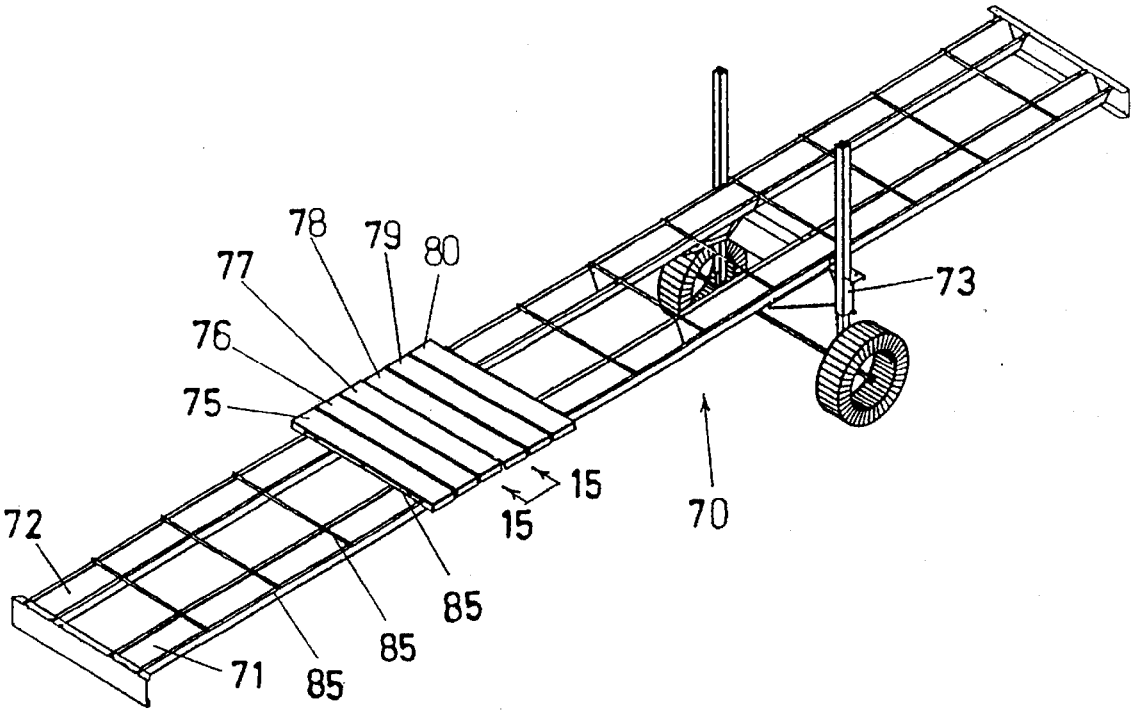
FIG. 13 is a perspective view of a V-channel dock.
Figure 14:
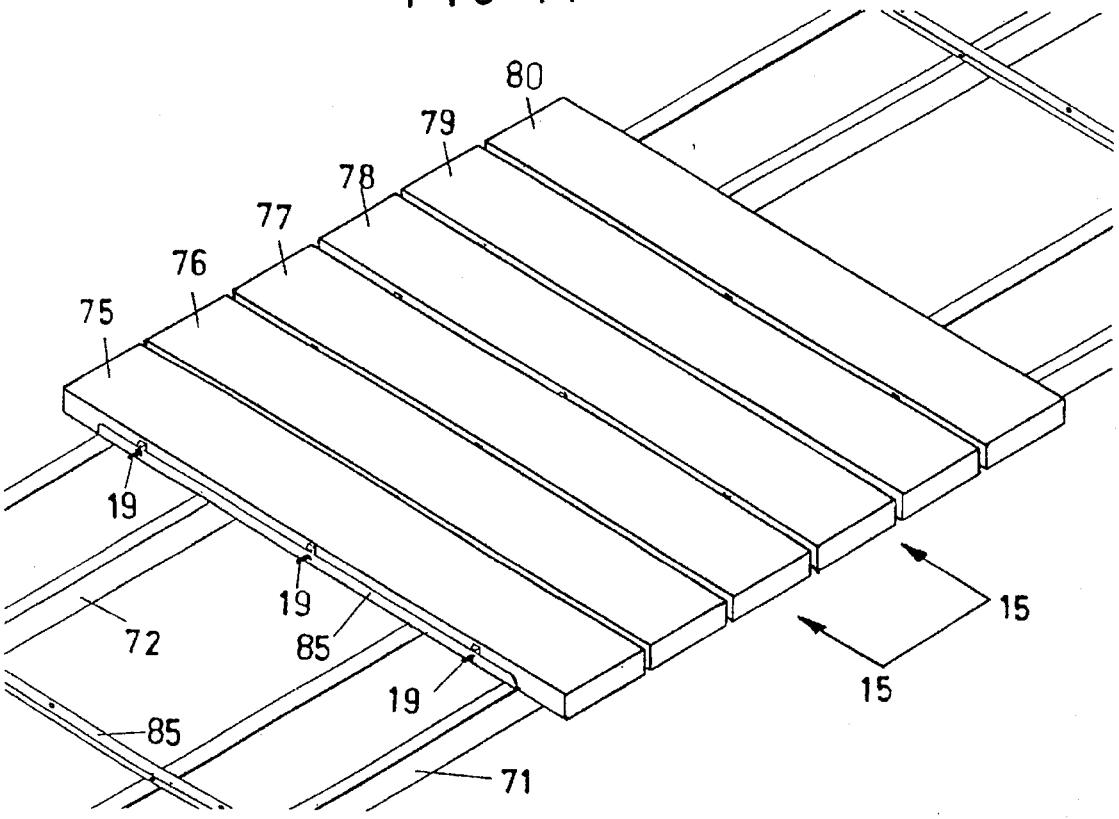
FIG. 14 is an enlarged view of the dock section of FIG. 13.
Figure 15:
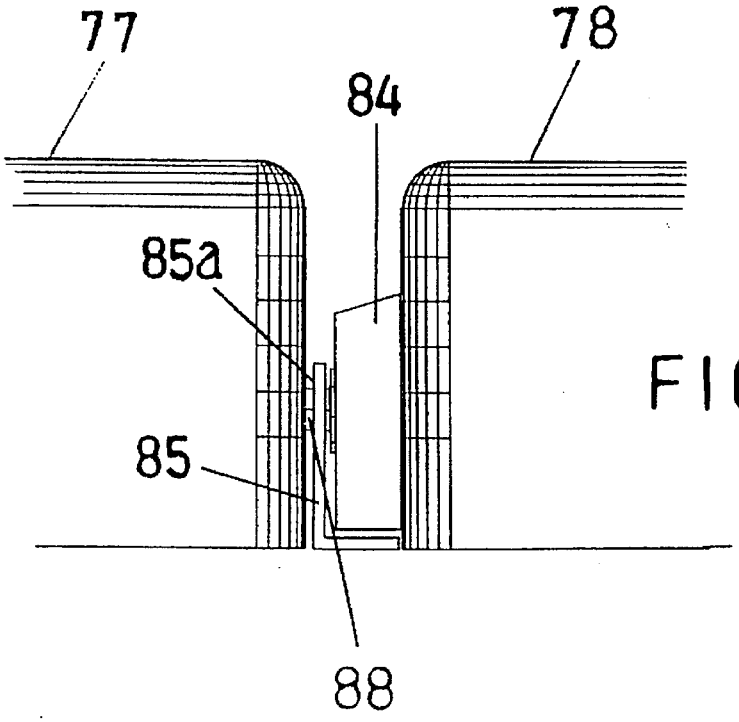
FIG. 15 is a view taken along line 15—15 of FIG. 14.

FIGS. 13, 14 and 15 show an alternate embodiment of my invention for use in retrofitting V-channel docks with my dock planks. FIG. 13 reference numeral 70 generally identifies a dock 70 having a first metal V-channel support member 71 and a second metal V-channel support member 72 which are supported by a wheeled frame 73. Located on top of V-channels 71 and 72 and secured thereto in groups of three or more are dock planks 75, 76, 77, 78, 79 and 80. Dock planks 75–80 are identical to dock plank 10 (FIG. 1) except that dock planks 75–80 do not contain metal reinforcing ribs secured to the individual planks. Dock planks 75 and 77 are connected to dock plank 76 through the use of bolts (FIG. 16) rather than cylindrical pins thus holding the dock planks of each section in a non shiftable relationship with respect to one another. Use of bolts allows one to form dock planks 75, 76 and 77 into an integral dock section for mounting between cross channels 85 (FIG. 13) located on V-channels 71 and 72. While each of the planks of each section is fixedly held with respect to the central plank the dock sections are held in a shiftable relationship through pins and openings in an adjacent plank.

FIG. 15 shows an end-view of planks 77 and 78 illustrating mounting of the dock sections containing planks 75, 76 and 77 in a shiftable relationship to dock section containing planks 78, 79 and 80 through support cross channel 85. Pin 88 extends from spacer 84 through an enlarged opening 85*a* in cross-channel 85 which is secured to V-channels 71 and 72 through fastener (not shown) and into an enlarged opening in plank 77. Consequently, the left side of plank 78 is laterally and longitudinally secured in a shiftable relationship against cross channel 85 by pin 88 engaging cross-channel 85 and, likewise, the plank 77 is secured in a shiftable relationship against cross-channel 85 by the free end of pin 88 which engages an enlarged mating opening in the backside of plank 77 (not shown).

Figure 16:
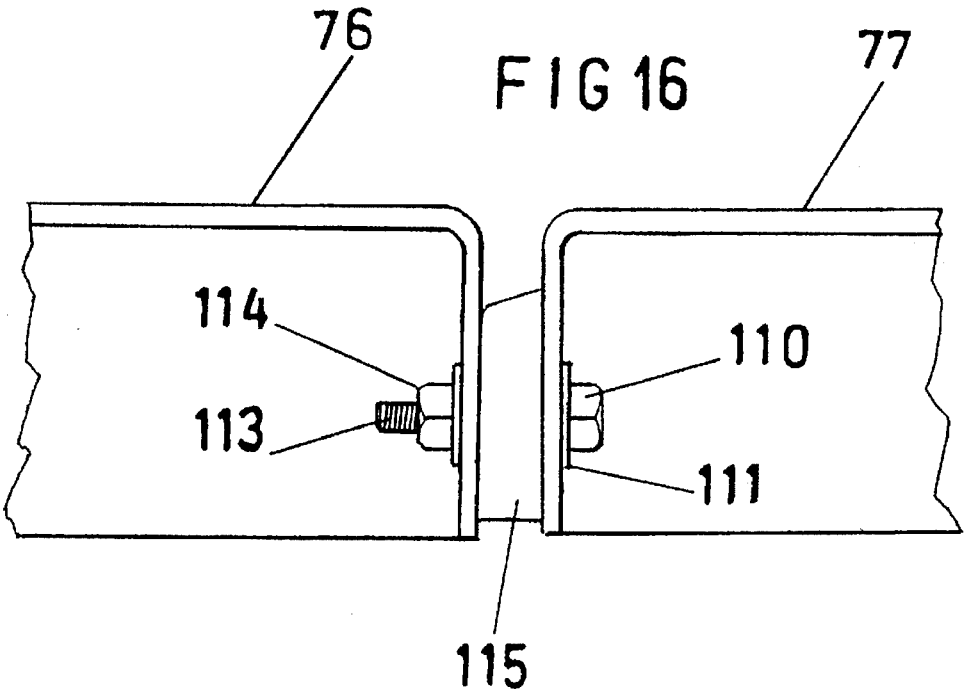
FIG. 16 is an enlarged partial sectional view showing the connecting link between individual planks in a dock section.

FIG. 16 shows plank 76 held proximate plank 77 by a bolt 110 having a threaded section extending through washer 111, spacer 115 and washer 112. A nut 114 on section 113 secures plank 76 to plank 77 to create a modular section.

Figure 17:
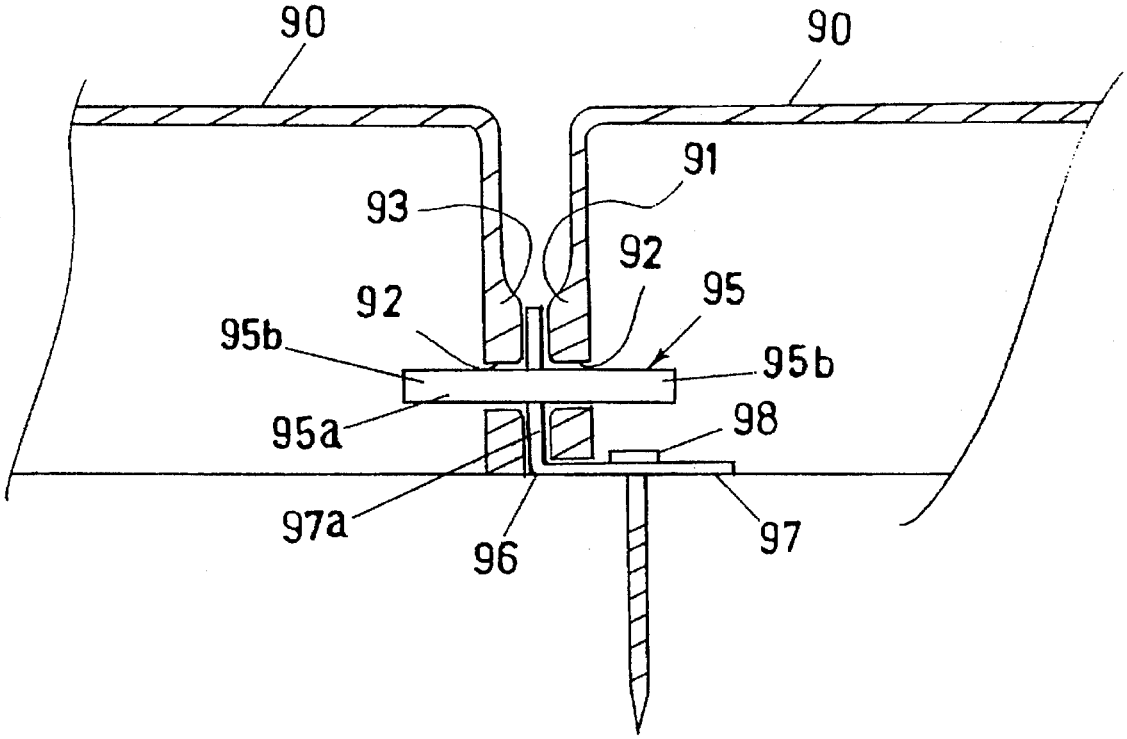
FIG. 17 is an alternate embodiment of a fastener for dock planks.

FIG. 17 shows an alternate fastening member 95 for shiftably securing adjacent planks to a dock support member. Member 95 comprises an angle member 96 having a first member 97 secured to a dock support member by nail 98. The right-angled member 97*a* connected to member 97 includes a cylindrical cross pin 95*a* having a first end 95*b* extending through enlarged opening 92' in spacer 93 of plank 90'. Similarly, end 95*b'* extends through enlarged opening 92 in spacer 91 to hold planks 90 and 90' in lateral shiftable relationship to one another.

Figure 18:
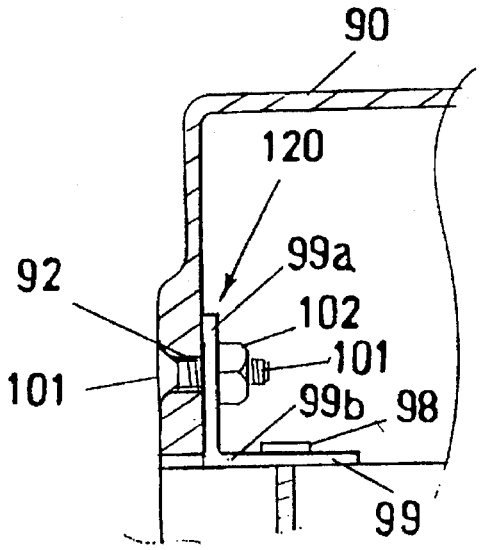
FIG. 18 shows a fastener for connecting the end dock plank.

FIG. 18 shows how end plank 90 is secured to a dock support member by end plank fastener 120. End plank fastener 120 includes an angle member comprised of member 99*a* and 99*b* with nail 98 extending through opening 99 to hold fastener 120 on dock support member. A bolt 100 extends through opening 92 in plank 90 and member 99*a* where it is secured to by nut 102 located on threads 101.

In the preferred embodiment plank 10 is injection molded from polyethylene or polypropylene and the reenforcing rib is made of galvanized metal.

FIG. 19 shows a dock frame 101 comprised of stringers 102 and 103 and cross members 104, 105, 106, and 107. Located on cross members are a set of L-shaped metal support clips 110 that have one leg fastened to a cross brace through a fastener such as a screw or the like. Metal support clip is shown in grater detail in FIG. 19*a* with leg 110*a* having openings 111 for fastening the leg 110*a* to a cross brace and leg 110*b* having an opening 112 for engaging with a pin of an adjacent dock plank.

FIG. 19 shows a set of three planks 115, 116, and 117 mounted on frame 101 with a set of transverse free-span ribs 118, 119 and 120 extending transverse to all three planks and spaced from the support ends of each plank. FIG. 20 shows dock plank 117 partially cut away to reveal transverse free-span rib 118 located in alignment with integral rib 121 of plank 117 and completely internal to box-like plank 117. Each of the ribs comprises a generally rectangular member having a thickness on the order of about ⅛ inch and a width on the order of about 1 inch and a length of about 3 feet. The dimensions are illustrating and no limitation is intended thereto.

FIG. 21 shows the ribs are positioned vertically and transverse with respect to each of the dock planks to provide the greatest amount of support to the dock planks. In order to accommodate the pins 95 the end of each of the ribs are notched so as not to interfere with the pins fastening each group of dock planks together as a dock plank assembly. In the preferred embodiment the free-span ribs are spaced approximately every two feet along the planks to provide the coactive plank support.

FIG. 21 shows dock plank 117 has an edge member 117*d* with a rectangular opening 117*a* therein and rib 117*c* with a rectangular opening 117*b* for extending rib 118 therethrough with the sides of the rectangular opening engaging the sides of rib 118 to hold the rib in a vertical orientation as shown in FIG. 20 and FIG. 21. Similarly each of the dock planks has rectangular openings therein with sidewalls to permit integral mechanical engagement between the rib and the dock plank. FIG. 20 and FIG. 21 reveal that rib 118 is in vertical alignment with the molded transverse rib 121 of plank 117 and likewise in vertical alignment with the molded transverse ribs of each of the other planks 115 and 116 so that the integral rib of each of the planks and multiplank rib 118 have the same vertical axis to thereby coact to provide support for an object or person on top of plank 117.

Rib 118 includes a first rib pin 131 extending outward therefrom for engaging rib 117*c* and a second rib pin 130 for engaging a rib 115*b* to hold planks 115, 116 and 117 in lateral position with respect to each other as well as to hold rib 118 in a coactive position with respect to all of the planks. First pin 131 is secured to free-span rib 118 for engagement with first plank 117 and a second pin 130 is secured to free-span rib 118 to second plank 115 to hold first plank 117 and second plank 115 proximate one another. The position of free-span rib 118 with respect to multiple planks produces a beam effect giving further support to the dock plank assembly.

Referring to FIGS. 19 to 21 my dock plank assembly can be shown to comprise a first elongated polymer plastic plank 117 having a first support end, a second support end, and a top surface for walking on, with plank 117 having an integral longitudinal web 117*c* therein for providing rigidity and support to plank 117 with web 117*c* having an opening 117*b* with side wall for engaging the sides of metal rib 118. Similarly, a second elongated polymer plastic plank 115 has a first support end, a second support end and a top surface for walking on with plank 115 having integral longitudinal web 115*b* therein for providing rigidity and support to the second plank with the web 115*b* having an elongated rectangular shaped opening 115*c* therein. Extending through the rectangular shaped openings 115*c* and 117*b* is an elongated free-span metal rib 118. Metal rib 118 is spaced from the support ends of planks 115 and 117 with the metal rib 118 extending transversely through the opening in the webs of plank 115 and 118. The metal rib 118 provides additional individual support for each of planks 115 and 117 and providing support for plank 115 and 117 as a unit to thereby maintain planks 115 and 117 in walking condition with respect to one another, i.e. so a person does not trip over a protruding edge of any of the planks. The drawing show the use of three planks in the dock plank assembly and more or less could be used, however a minimum of two planks are necessary to provide the coactive support for planks as a unit that inhibits buckling or bending of the planks.

A further feature of my invention is that the free-span ribs provide a safety feature in that if a plank should be broken for any reason the free-span ribs would provide sufficient integrity to support a person thereon to prevent the person from falling through the dock. The free-span ribs are made of metals such as steel or galvanized metal in order to provide both the support and the ability to withstand harsh environments. In order to provide the strength and flex to the dock plank the free span rib is placed in the neutral axis of the plank so that the rib can work effectively to either support a weight on the plank or prevent a buckling of the plank due to temperature changes.

I claim:

1. A dock plank assembly comprising:

a first elongated polymer plastic plank having a first support end, a second support end, and a top surface for walking on, said first plank having an integral longitudinal web therein for providing rigidity and support to said first plank with said web of said first plank having an opening therein, a second elongated polymer plastic plank having a first support end, a second support end for supporting said second plank, said second plank having a top surface for walking on, said second plank having integral longitudinal web therein for providing rigidity and support to said second plank with said web of said second plank having an opening therein;

a metal free-span rib, said metal rib spaced from said support ends of said first plank and said second plank with said metal rib extending transversely through said opening in said web of said first plank and said opening in said web of said second plank to provide rigidity and additional individual support for each of said planks and for providing support for said first plank and said second plank as a unit to thereby maintain said first plank and said second plank in surface walking condition with respect to one another;

a first pin secured to said free-span rib for engagement with said first plank; and a second pin secured to said free-span rib to said second plank to hold said first plank and said second plank proximate one another.

2. The dock assembly of claim 1 wherein each of said planks includes integral ribs located in vertical alignment with said metal rib.

3. The dock plank assembly of claim 2 wherein said metal rib has a rectangular cross section.

4. The dock plank assembly of claim 1 wherein the first plank comprises a one-piece injection molded plank for mounting on a dock support with the one-piece injection molded plank having an elongated open box shape with a front side and a back side.

5. The dock plank assembly of claim 1 wherein said first plank includes an integral reinforcing rib with said integral rib located parallel to said metal rib.

6. The dock plank assembly of claim 1 wherein said first plank includes at least two integral reinforcing ribs.

7. The dock plank assembly of claim 6 wherein each of said reinforcing ribs includes at least two surfaces which are at a right angle to one another to provide stiffness to said reinforcing rib.

8. The dock plank assembly of claim 1 wherein said first dock plank and said second dock plank have the respective top surfaces located in substantially the same plane.

9. The door plank assembly of claim 1 wherein said elongated planks are polypropelene or polyethylene and said metal rib is galvanized metal.

10. The dock plank assembly of claim 1 wherein said free-span rib is located internal to said planks.

11. The dock plank assembly of claim 10 wherein said dock plank assembly includes at least two free-span ribs positioned parallel to each other.

* * * * *